US007798843B1

(12) United States Patent
Wu

(10) Patent No.: US 7,798,843 B1
(45) Date of Patent: Sep. 21, 2010

(54) CONNECTOR ASSEMBLY WITH IMPROVED CABLE RETAINING MEANS

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/456,631

(22) Filed: Jun. 19, 2009

(51) Int. Cl.
*H01R 13/58* (2006.01)

(52) U.S. Cl. ..... 439/455

(58) Field of Classification Search ..... 439/455, 439/607.5, 607.51, 607.52, 607.47
See application file for complete search history.

(56) References Cited

U.S. PATENT DOCUMENTS 2,798,113 A * 7/1957 Koller et al. ..... 174/75 C
2,954,420 A * 9/1960 Logan ..... 174/75 C
3,054,981 A * 9/1962 Malek et al. ..... 439/585
4,416,501 A * 11/1983 Fusselman et al. ..... 439/396
4,457,576 A * 7/1984 Cosmos et al. ..... 439/607.47
4,592,612 A * 6/1986 Kikuta ..... 439/607.47
4,713,023 A * 12/1987 Bixler et al. ..... 439/393
4,891,022 A * 1/1990 Chandler et al. ..... 439/607.51
5,108,313 A * 4/1992 Adams ..... 439/607.47
5,429,529 A * 7/1995 Hashizawa et al. ..... 439/607.5
6,402,550 B2 * 6/2002 Matsubara ..... 439/578
7,134,914 B1 11/2006 Wu
7,416,433 B1 8/2008 Wu

* cited by examiner

*Primary Examiner*—Neil Abrams
(74) *Attorney, Agent, or Firm*—Wei Te Chung; Andrew C. Cheng; Ming Chieh Chang

(57) ABSTRACT

A cable assembly (100) includes a housing having a mounting section, a retaining cavity defined in an interior side of the mounting section, and a mounting cavity (1030) defined in an external side of the mounting section. An ejection mechanism is assembled to the housing, the ejection mechanism including a slider (4) mounted to the housing, a bail (3) assembled to the mounting section and engaged with the slider. The bail (3) has a transverse handle portion (30) accommodated in the mounting cavity (1030) and a pair of driving arms (31) connected to the handle portion and pivotally engaged with the housing to cause outward movement of ejector (5) to separate the cable assembly from a mating receptacle. A cable (8) includes a number of wires (85), an inner layer (83) enclosing the wires, a metallic braiding (84) shielding the inner layer, and an outer jacket (81) covering the metallic braiding. A second ring (92) is mounted between the metallic braiding and the inner layer. A first ring (91) is crimped onto an outside of the outer jacket, with the metallic braiding shielding and the outer jacket sandwiched between the first ring and the second ring (92), the first ring accommodated in the retaining cavity (121, 221).

2 Claims, 8 Drawing Sheets

CONNECTOR ASSEMBLY WITH IMPROVED CABLE RETAINING MEANS

BACKGROUND OF THE INVENTION

1. Field of the Invention

The present invention generally relates to a cable assembly, and more particularly to a cable assembly with improved retaining means.

2. Description of Related Art

SFP (Small Form-factor Pluggable), X-SFP and QSFP are all modules for optoelectrical transmission. Reduced Form Factor and size are very important to those modules. The smaller the form factor of the module, the less space taken on a printed circuit board to which it mounted. A smaller form factor allows a greater number of modules to be coupled onto a printed circuit board to support additional communication channels. However, with data transmission increased, a gauge of wires becomes larger accordingly, which has been ranged from 28 AWG to 24 AWG. The wires should be securely terminated to the module. Additional retaining devices are needed to hold the cable. Thus a whole dimension of a cable assembly may increase.

U.S. Pat. No. 7,134,914 issued to Wu on Nov. 14, 2006 discloses a typical cable assembly with a retaining (holding) device for a cable thereof. The retaining device has an arch-shaped body portion with a number of tooth-shaped protrusions formed on an inner side of the body portion. The retaining device is crimped onto the cable and accommodated in a corresponding cavity defined in a cover of the cable assembly. However, an inner structure of the cable may be destroyed during crimping process, which may negatively influence impedance and other electrical properties of a cable.

Hence, an improved cable assembly is desired to overcome the aforementioned problem.

BRIEF SUMMARY OF THE INVENTION

Accordingly, an object of the present invention is to provide low profile a cable assembly with improved retaining device.

In order to achieve the above-mentioned object, a cable assembly comprises a housing having a mounting section and a mating section extending forwardly from the mounting section, a retaining cavity defined in an interior side of the mounting section, and a mounting cavity defined in an external side of the mounting section. An ejection mechanism is assembled to the housing, the ejection mechanism including a slider mounted to the housing, a bail assembled to the mounting section and engaged with the slider and capable of rotating to actuate the slider linearly movement. Said bail has a transverse handle portion accommodated in the mounting cavity and a pair of driving arms connected to the handle portion and pivotally engaged with the housing. A cable includes a number of wires, an inner layer enclosing the wires, a metallic braiding shielding the inner layer, and an outer jacket covering the metallic braiding. A second ring is mounted between the metallic braiding and the inner layer. A first ring is crimped onto an outside of the outer jacket, with the metallic braiding shielding and the outer jacket sandwiched between the first ring and the second ring, the first ring accommodated in the retaining cavity.

Other objects, advantages and novel features of the invention will become more apparent from the following detailed description of the present embodiment when taken in conjunction with the accompanying drawings.

DETAILED DESCRIPTION OF THE INVENTION

Figure 1:
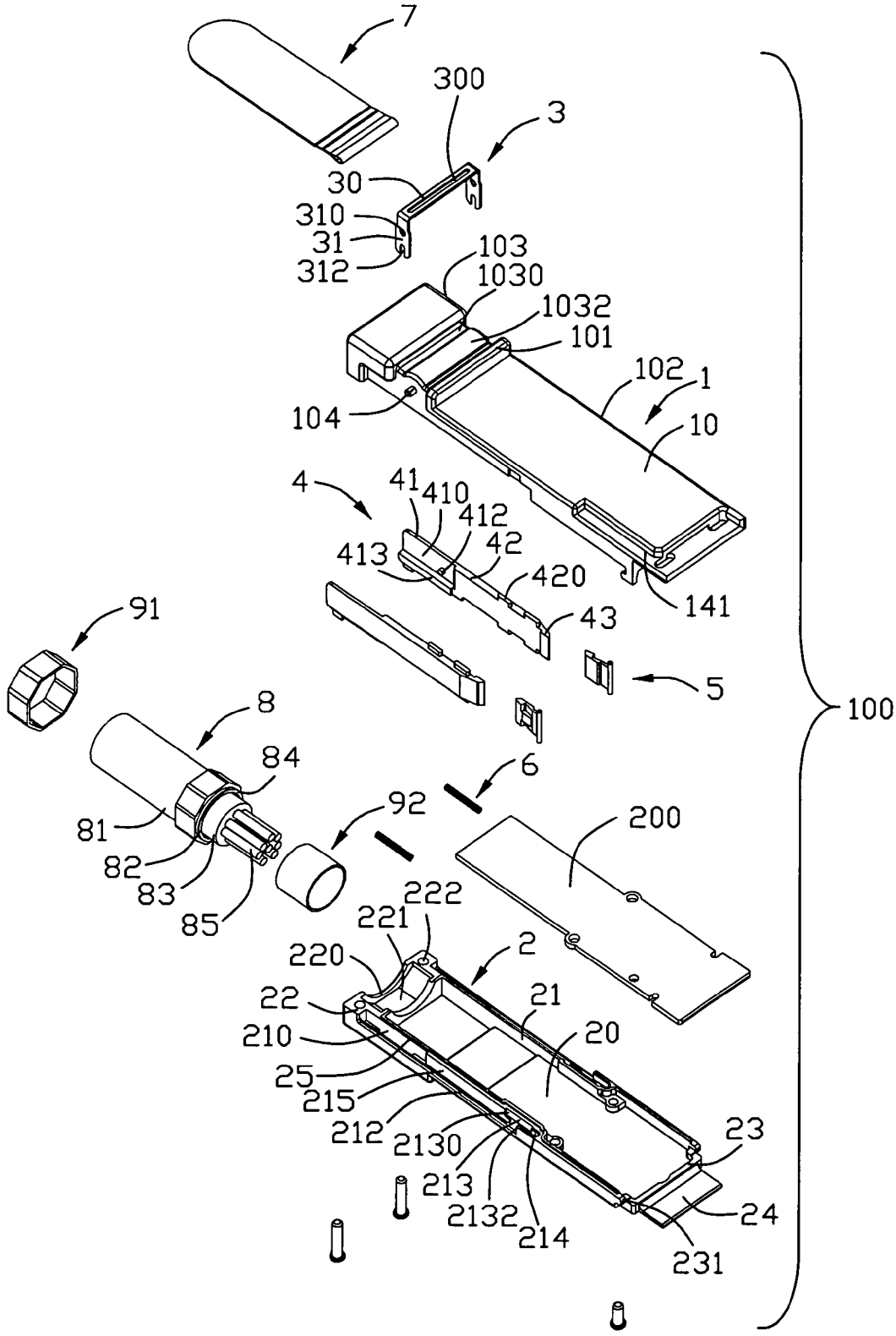
FIGS. 1-3 are exploded, perspective views of a cable assembly in accordance with the present invention and viewed from different aspects.

Reference will now be made to the drawing figures to describe the present invention in detail.

Figure 2:
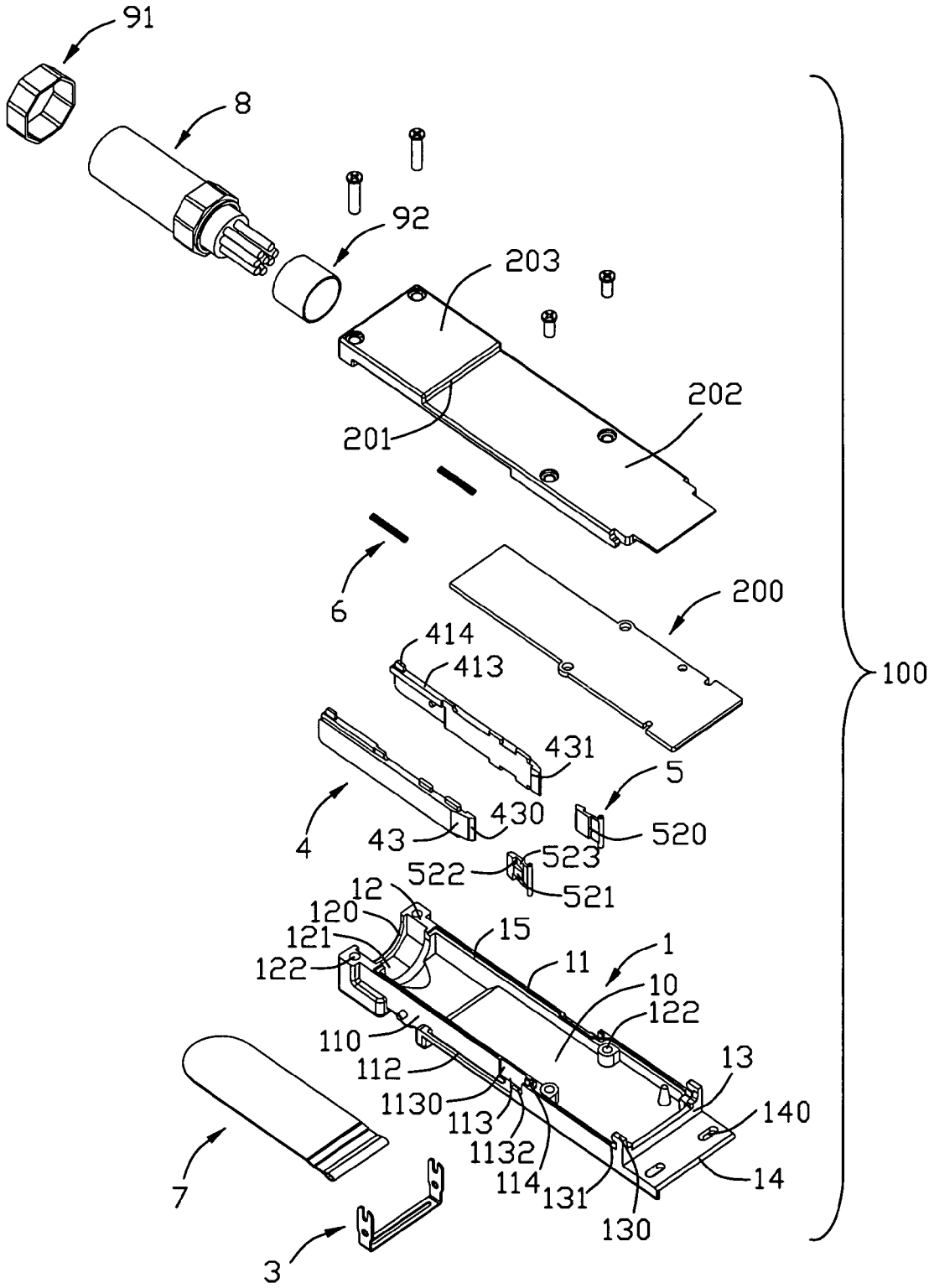
Figure 3:
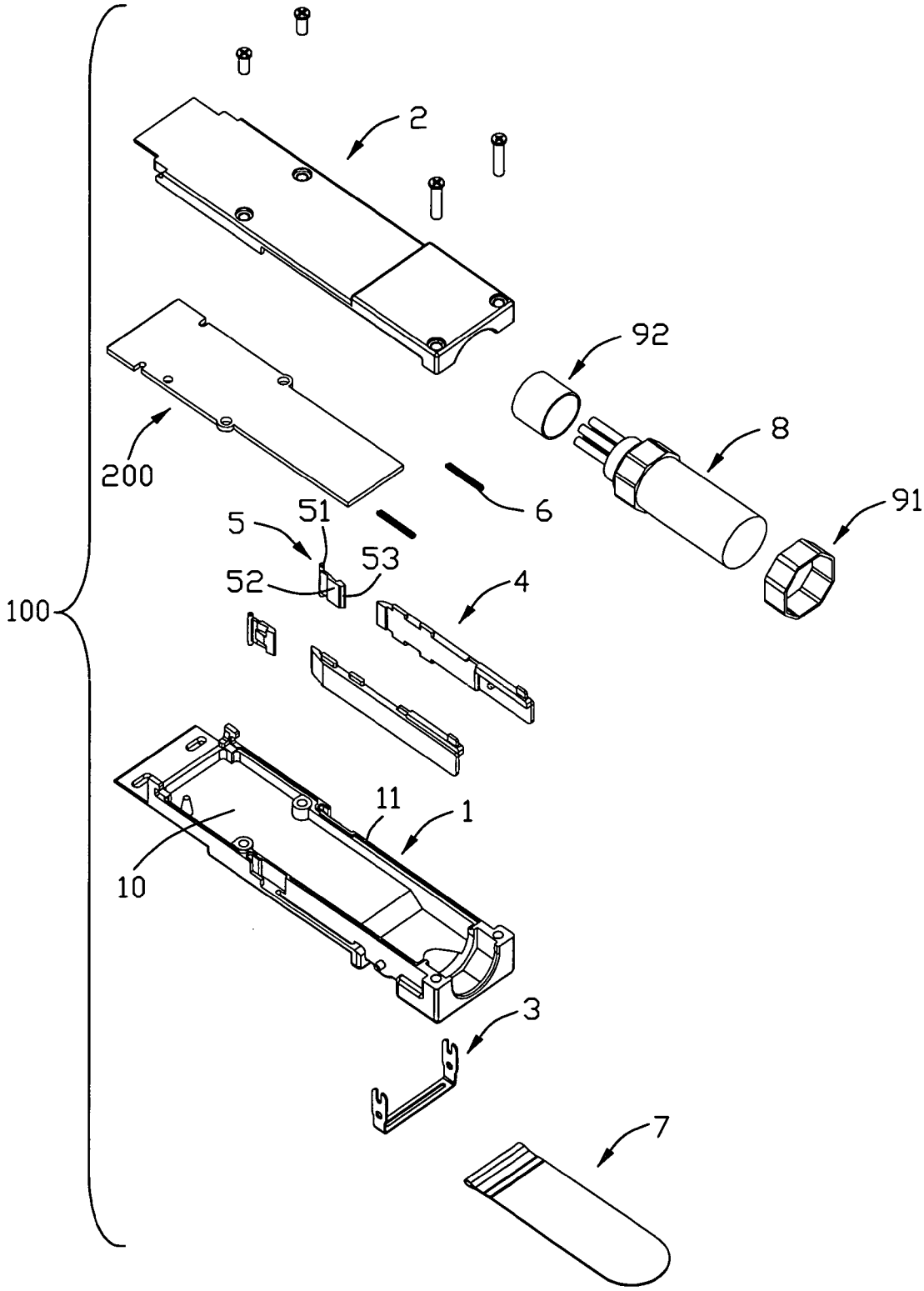
Figure 4:
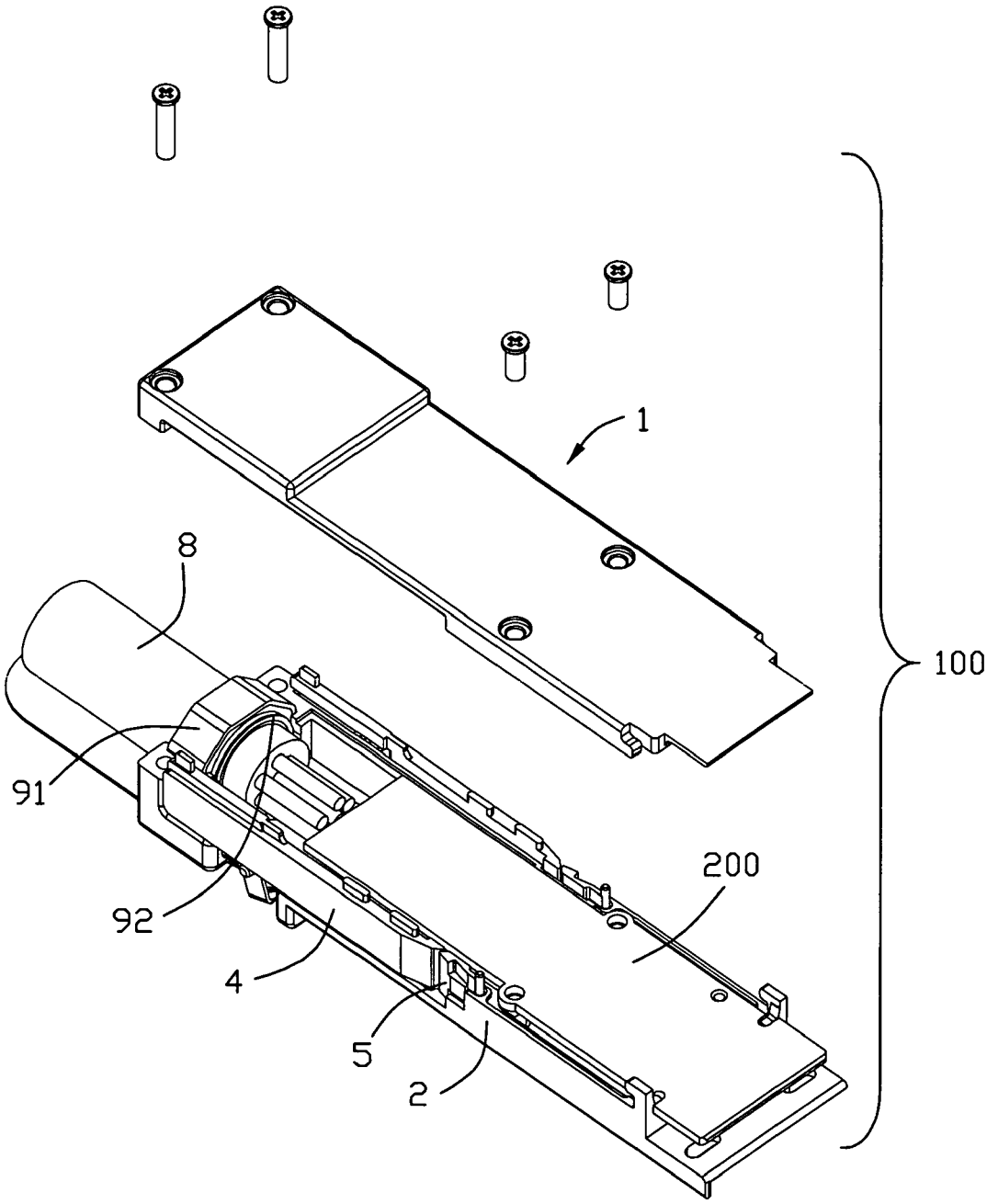
FIG. 4 is a partially assembled view of FIG. 2.
Figure 5:
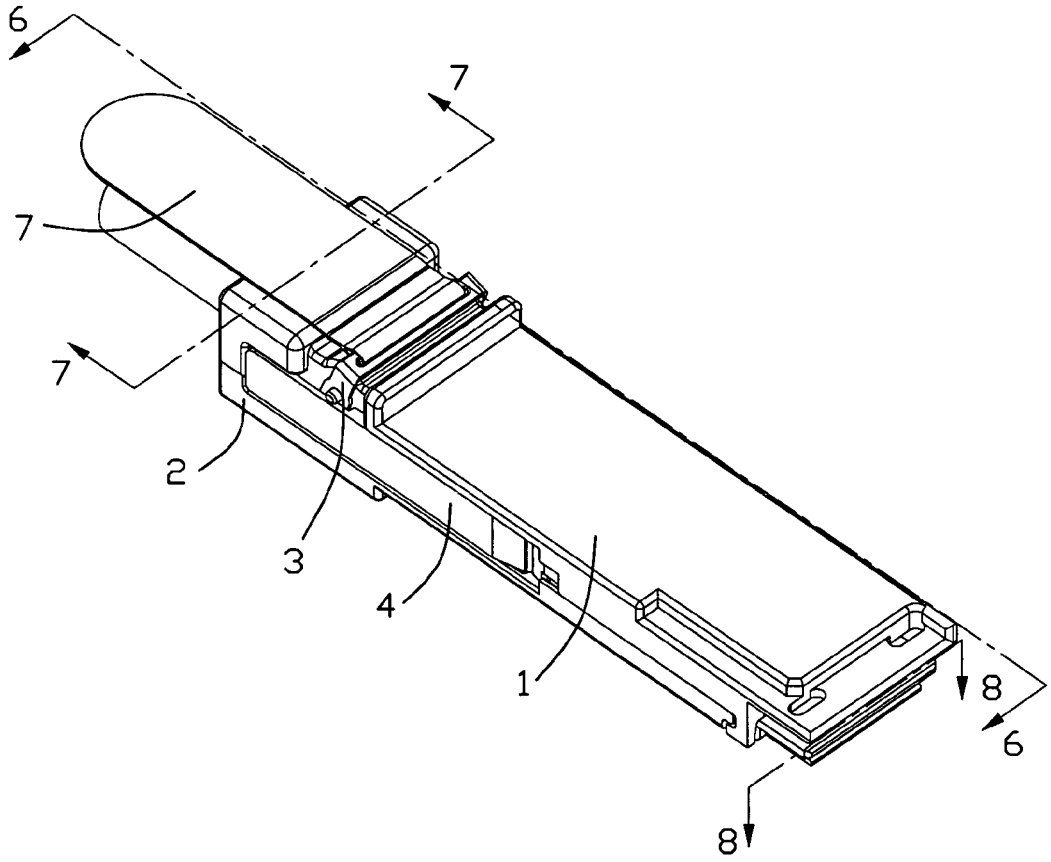
FIG. 5 is an assembled view of the cable assembly of FIG. 1.
Figure 6:
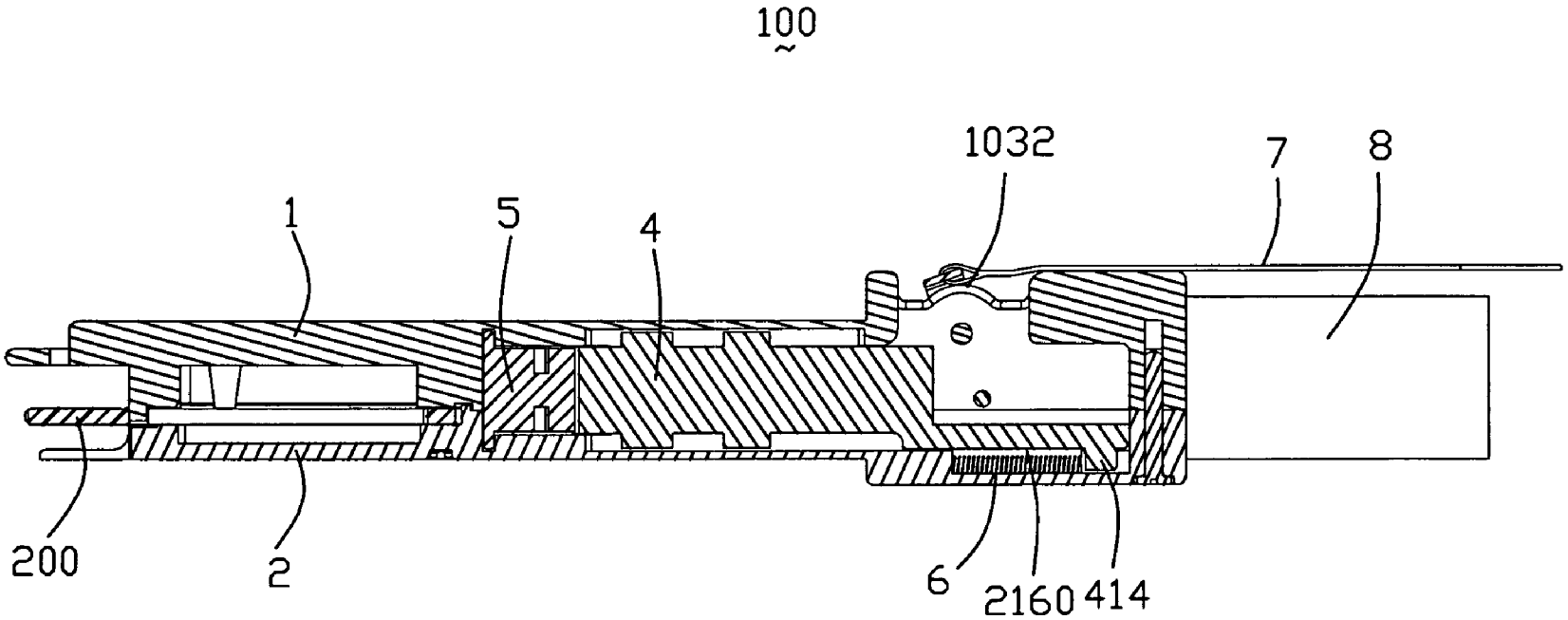
FIGS. 6-8 are cross-section views of the cable assembly taken along lines 6-6 to 8-8 of FIG. 5.
Figure 7:
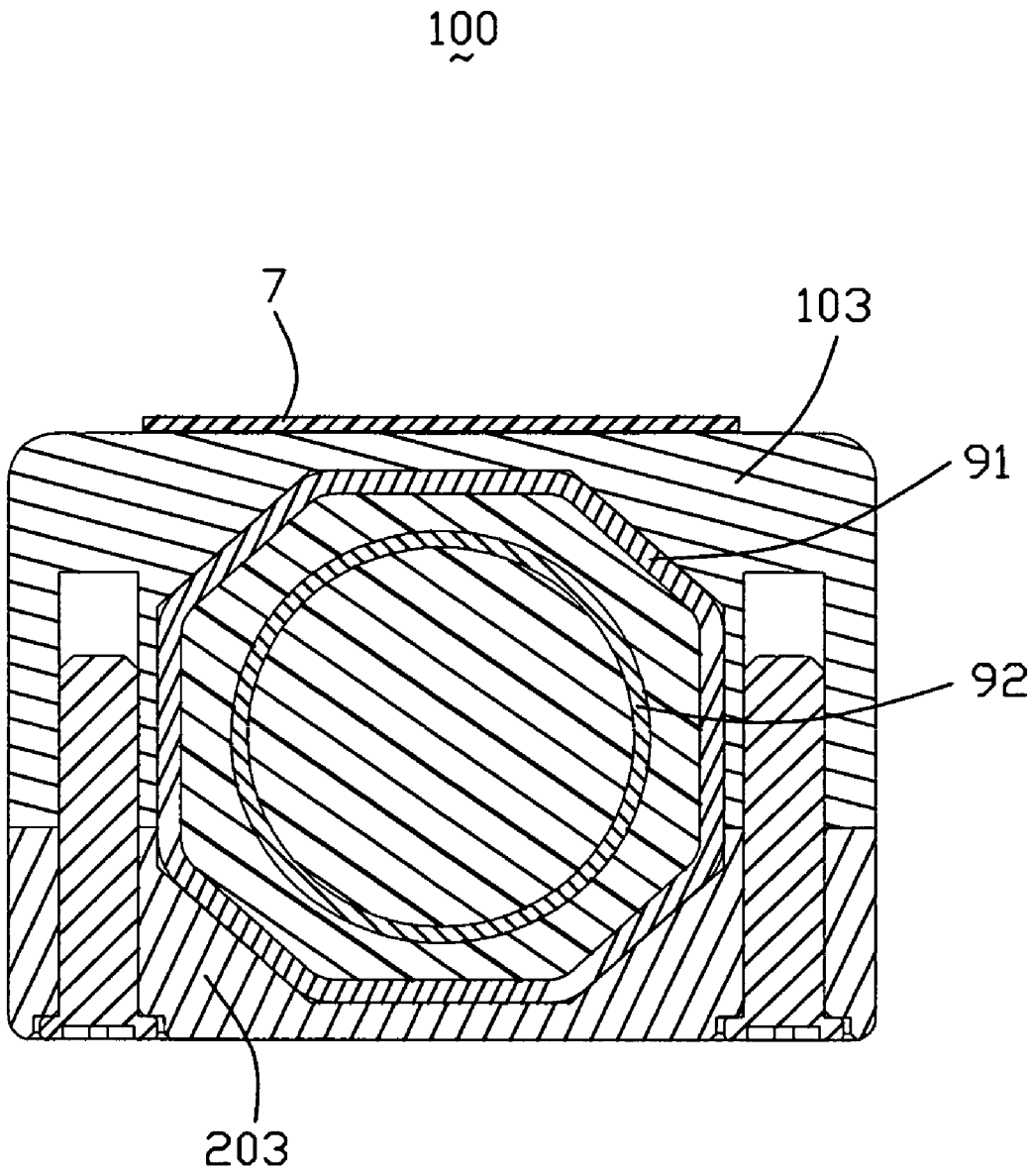
Figure 8:
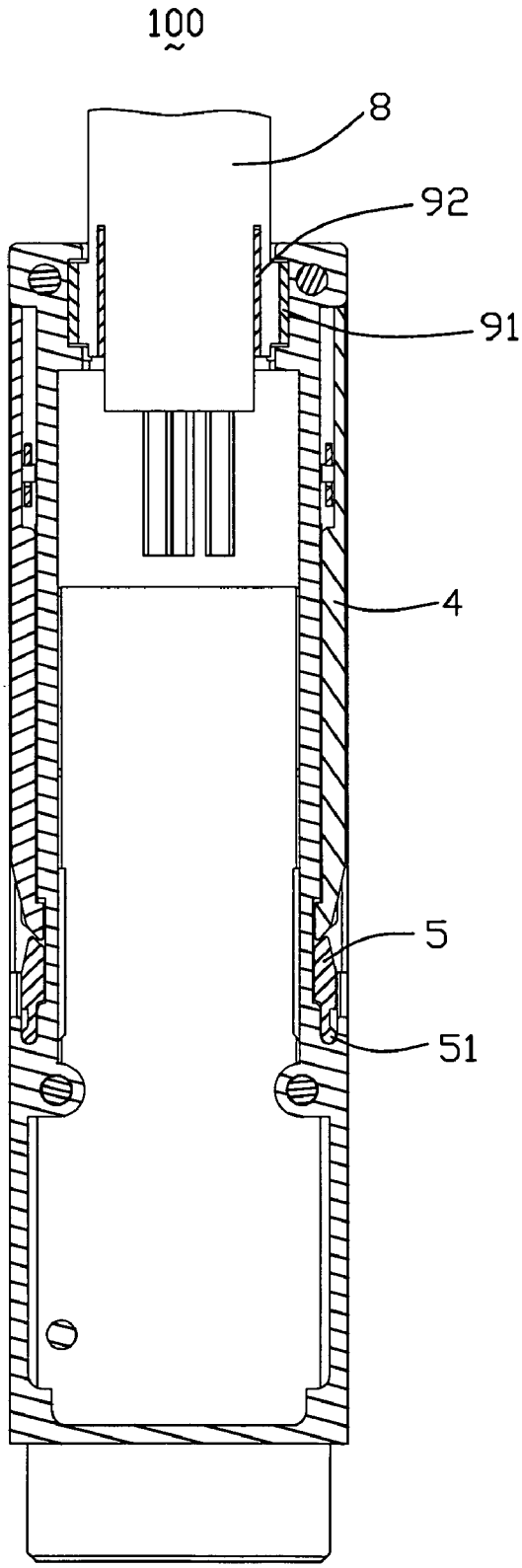

Referring to FIGS. 1-8, a cable assembly 100 in accordance with the present invention comprises a base 2, a cover 1 assembled with the base 2 to form a die case housing, and an ejection mechanism assembled to the base 2 and the cover 1 for unplugging the cable assembly 100 from a receptacle module (not shown) conveniently. A printed circuit board (PCB) 200 is received in the die case housing. A cable 8 is terminated to the PCB 200.

The ejection mechanism comprises a pair of die-cast sliders 4 assembled to the base 2 and the cover 1, a pair of die-cast ejectors 5 assembled to the base 2 and the cover 1 and capable of being actuated by the sliders 4, a bail 3 stamped from metal sheet. The bail 3 is assembled to the cover 1 and engaged with the sliders 4 and capable of rotating to actuate the sliders 4 linearly movement. A pair of bias elements 6 is assembled to the base 2 and the sliders 4 for providing elastic restoring force to the sliders 4, and a pulling tape 7 attached to the bail 3.

The cover 1 comprises a step-shaped main upper wall 10, a pair of first sidewalls 11 extending downwardly from opposite side edges of the upper wall 10, opposite first front and rear walls 13, 12 with different heights downwardly extending from front and rear edges of the upper wall 10 and connecting with the pair of first sidewalls 11. The upper wall 10 extends forwardly beyond the first front wall 13 to form a first front flange 14 with a pair of elliptical holes 140 laterally arranged. An L-shape cutout 141 recesses downwardly from upper surface of the upper wall 10 and locates at a left corner of the upper wall 10. A flange 101 is formed on the upper wall 10 to divide the cover 1 into a front first mating section 102 and a rear first mounting section 103 which is higher and shorter than the first mating section 102 but lower than the flange 101. The flange 101 indicates the final inserting position of the cable assembly 100. A mounting cavity 1030 is defined in an exterior side of the first mounting section 103 and disposed behind the flange 101. An arch-shaped protrusion 1032 is located in the mounting cavity 1030.

The opposite first sidewalls 11 are partially cut inwardly to form a pair of first accommodating spaces 110 which extend from a position adjacent to the first rear wall 12 till a middle position of the first mating section 102 corresponding to contours of the sliders 4. The rear section of the first accommodating space 110 adjacent the flange 101 is formed by completely cutting through the first sidewall 11 along up-to-down direction to communicate with the mounting cavity 1030. The front section of the first accommodating space 110 in front of the flange 101 is formed by partially cut the first sidewall 11 along up-to-down direction with upper flange of the first sidewall 11 left and a first sliding slit 112 recessed in the upper flange. A first cooperating recess 113 is recessed inwardly from forward end of the first accommodating space 110 and opens toward outside. A circular first pivot hole 114 recesses upwardly from the first sidewall 11 and communicates with the first cooperating recess 113. The first cooperating recess 113 further communicates with the first accommodating space 110 and the first sliding slit 112. The first cooperating recess 113 forms an inner first step 1130 and an L-shape outer second step 1132 respectively corresponding to the contours of the sliders 4 and the actuators 5. Two rods 104 respectively project outwardly from the first sidewall 11 and locate adjacent to the protrusion 1032. Each rod 104 is located in corresponding first accommodating space 110 for cooperating with the bail 3.

The first rear wall 12 has a relatively large thickness along mating direction and defines a first semicircular exit opening 120 for the exist of the cable 8. A first retaining cavity 121 is defined in the first semicircular exit opening 120. A pair of first screw holes 122 are defined at opposite sides of the exit opening 120. Another pair of first screw holes 122 are formed in a pair of standoffs formed adjacent to the first pivot holes 114. A pair of tips 130 are formed at two corners of the first front wall 13 and located below the first front wall 13 to form a pair of spaces 131 between the bottom surfaces of the first sidewalls 11. A continuous slot 15 recesses upwardly from inner edges of the first sidewalls 11 and the first rear wall 12.

The base 2 comprises a step-shaped bottom wall 20, a pair of second sidewalls 21 extending upwardly from opposite side edges of the bottom wall 20, opposite second front and rear walls 23, 22 upwardly extending from front and rear edges of the bottom wall 20 and connecting with the pair of second sidewalls 21.

The bottom wall 20 comprises a front second mating section 202 and a rear second mounting section 203 lower than the second mating section 202 to form a second flange 201 therebetween for indicating the final inserting position of the cable assembly 100 together with the first flange 101. The second rear wall 22 has a relatively large thickness along the mating direction and partially cut to form a semicircular second exit opening 220 which cooperates with the first exit opening 120 to form an exit channel for the exist of the cable 8. A second retaining cavity 221 is defined in the second exit opening 220. The second retaining cavity 221 cooperates with the first retaining cavity 121 to form a retaining cavity. The second rear wall 22 also defines a pair of circular second screw holes 222 at opposite sides of the second exit opening 220 corresponding to the first screw holes 122 for a pair of screws (numbered) protruding therethrough to fasten the base 2 with the cover 1 together. The bottom wall 20 extends beyond the second front wall 23 to form a second front flange 24 parallel spaced from the first front flange 14. The PCB 200 is accommodated between the base 2 and the cover 1, with a front end thereof exposed between the front flanges 14, 24.

Each second sidewall 21 has different thicknesses along the mating direction of the cable assembly 100. The middle and rear sections of the sidewall 21 are thicker than front section of the sidewall 21 and form the thicker section of the sidewall 21 and the front section is a thinner section of the sidewall 21. The rear section and the middle section of the sidewall 21 is partially cut to form a second accommodating space 210 which opens toward outside corresponding to the first accommodating space 110 of the cover 1 to corporately form an accommodating channel of the cable assembly 100 to receive the sliders 4. A protruding block 215 protrudes outwardly from middle section of the inner part of the sidewall 21 to divide the second accommodating space 210 into a wider rear receiving section, a middle second sliding slit 212 corresponding to the first sliding slit 112 and a front second cooperating recess 213 corresponding to the first cooperating recess 113. A second pivot hole 214 is defined in a front end of the middle section of the second sidewall 21 corresponding to the first pivot hole 114 and communicates with the second cooperating recess 213. Corresponding to the first and second steps 1130, 1132, the second cooperating recess 213 forms an inner first step 2130 on inner part of the second sidewall 21 and an outer second step 2132 on outer part of the second sidewall 21. A continuous rib 25 forms on inner periphery of the pair of second sidewalls 21 and the second rear wall 22 for being received in the continuous slot 15. A pair of tips 231 extends forwardly from forward ends of the pair of second sidewalls 21 and locates above the second front wall 23. A bias receiving slot 2160 (FIG. 6) recesses downwardly from the second accommodating space 210.

The pair of sliders 4 are arranged face-to-face to be assembled to the base 2 and the cover 1. Each slider 4 comprises a rear mounting portion 41, a middle main body 42 and a front leading end 43. The mounting portion 41 is partially cut to define a cutout 410 on interior surface thereof and forms a pin 412 in the cutout 410. A lower supporter 413 is formed below the cutout 410 and part of the main body 42. A foot portion 414 downwardly extends from the lower supporter 413 and adjacent to a rear end of the slider 4. The main body 42 is a rectangular body with two pairs of guiding portions 420 formed on upper and lower edges thereof adjacent to interior surface thereof. One pair of guiding portions 420 aligning with each other along vertical direction is in a middle position of the main body 42 and the other pair locates adjacent to the leading end 43. The leading end 43 forms an actuating surface 430 on outer surface thereof and a step-shape latch 431 on inner surface thereof.

The pair of ejectors 5 are assembled to the base 2 and the cover 1 to be actuated by the sliders 4 for releasing the cable assembly 100 from the receptacle module. Each ejector 5 comprises a front pivot 51 vertically arranged for being received in the first and second pivot holes 114, 214, and a main portion 52 extending rearwardly from the pivot 51 with an inclined surface 53 formed at distal end of the main portion 52. The main portion 52 comprises an inner surface and an opposite outer surface. A first block rib 520 is formed on the inner surface of the main portion 52 and adjacent to the pivot 51 and a pair of wedge-shape cutouts 523 is defined at upper and lower sections of the main portion 52 to form a bridge 521 and a pair of second block ribs 522.

The bail 3 is of U-shaped and comprises a transverse handle portion 30 formed with a slot 300 thereon, and a pair of driving arms 31 extending downwardly from opposite sides of the handle portion 30 for cooperating with the cover 1 and actuating the sliders 4 to forwardly move and cause the ejectors 5 outwardly movement to separate the cable assembly 100 from the receptacle module. Each driving arm 31 defines a circular hole 310 in an upper section thereof and a U-shaped cutout 312 defined in a free end thereof.

The cable 8 includes a number of wires 85, an inner layer 83 enclosing the wires 85, a metallic braiding 84 shielding the inner layer 83, and an outer jacket 81 covering the metallic braiding 84. The inner layer 83 may be aluminum layer, Mylar part, etc.

A first ring (outer ring) 91 and a second ring (inner ring) 92 are used for holding the cable 8. The first ring 91 and the second ring are made of sheet metal or other materials. The first ring 91 is larger than the second ring 92. The first ring 91 is regular octahedron configuration viewed from a front side. However, the first ring 91 may be regular hexagon configuration. The first ring 91 is crimped onto peripheral side of the outer jacket 81, and the second ring 92 is inserted into a slot 82 of the cable 8, arranged between the metallic braiding 84 and the inner layer 83. The outer jacket 81 and the metallic braiding 84 are reliably sandwiched between the first ring 91 and second ring 92. The first ring 91 is accommodated in the retaining cavity, with a plurality of planar sides (e.g. eight planar sides in the present embodiment) thereof intimately and compliantly abutting against an interior (similar shape corresponding to the planar sides/contour of the first ring 91) of the retaining cavity, and therefore the first ring 91 is unable to be deformed and is able to constantly exert an balanced inwardly force onto the second ring 92, thus the cable 8 is securely combined with the housing. The second ring 92 is not easily deformed when the first ring 91 is crimped onto the outer jacket 81. Therefore, the cable 8 is prevented from being damaged.

In assembling, the bail 3, the sliders 4 and the ejectors 5 are firstly assembled to the cover 1. The bail 3 is firstly assembled to the cover 1, with the pair of rods 104 of the cover 1 inserting into the circular holes 310 of the driving arms 31 and the free ends of the driving arm 31 extend into the first accommodating spaces 110, the handle portion 30 accommodated in the mounting cavity 1030. Then, the sliders 4 are assembled to the cover 1 along down-to-up direction. The upper portions of the sliders 4 occupy the first accommodating spaces 110 with outer surfaces of the sliders 4 substantially coplanar with the outer surfaces of the first sidewalls 11. The pair of pins 412 of the mounting portions 41 of the sliders 4 protrudes into the cutouts 312 and the upper pair of guiding portions 420 is received into the first sliding slit 112 and capable sliding along the first sliding slit 112. The upper sections of the leading ends 43 are received in the first cooperating recess 113 with the latches 431 latching with the first step 1130. The ejectors 5 are assembled to the cover 1 with the pivots 51 inserted into the first pivot holes 114 and the main portion 52 occupying the left spaces of the first cooperating recesses 113. In such circumstances, the actuating surfaces 430 of the sliders 4 attach to the inclined surfaces 53 of the ejectors 5 in the first cooperating recess 113 without clearance. The L-shape second step 1132 abuts against the bridge 521 and the second block rib 522.

The pair of bias elements 6 are firstly assembled to the base 2 and received in the bias receiving slots 2160. The base 2 is then assembled to the cover 1, the sliders 4 and the ejectors 5 together with the pair of bias elements 6 with the pair of tips 231 inserted into the spaces 131 of the cover 1 then rotating the base 2 a certain angle to combine the base 2 and the cover 1 together. The lower sections of the sliders 4 and the ejectors 5 occupy the second accommodating space 210, the second cooperating recess 213 and the second pivot hole 214 in a manner similar to the assembly described above. The foot portion 414 of the mounting portion 41 is received in the slit (not shown) to abut against one end of the bias element 6 for compressing the bias element 6 and the pair of guiding portions 420 are received in the second sliding slit 212 and capable of sliding along the second sliding slit 212. The remaining portions of the leading end 43 and the main portion 52 of the ejector 5 are corporately received in the second cooperating recess 213 and the remaining portion of the pivot 51 is received in the second pivot hole 214.

The first and second accommodating spaces 110, 210 corporately form the accommodating channel to receive the sliders 4, and the first and second cooperating recesses 113, 213 corporately form a cooperating space which is commonly used by the sliders 4 and the ejectors 5. The bail 3 is located in a vertical first position when the cable assembly 100 mates with the receptacle module. When removing the cable assembly 100 from the receptacle module, operator may pull the pulling tape 7 to exert a rearward force to the bail 3 reaching a second position. The bail 3 rotates around the rods 104 along counter-clockwise direction, while the pins 412 received in the cutouts 312 together with the sliders 4 move forwardly with the guiding portions 420 sliding along the first and second sliding slits 112, 212 and the foot portions 414 compressing the bias elements 6. Thus, the actuating surface 430 slides along the inclined surface 53 of the ejector 5 to actuate the main portion 52 of the ejector 5 outwardly move with the pivots 51 rotating in the first and second pivot holes 114, 214. The outwardly moving main portions 52 push tabs of the receptacle module then escape from the latch condition with the tabs, operator may pull the bail 3 rearwardly to pull the cable assembly 100 from the receptacle module. When release the pulling force to the bail 3, the compressed bias elements 6 resume to their original position, thus, providing elastic restoring force to the sliders 4 and the ejectors 5. The pulling tape 7 is adjacent to and supported by a top side of the mounting section (FIGS. 5-6) when pulled reawardly and horizontally.

However, in alternative embodiment, the ejector 5 and the slider 4 may be formed as an one-piece configuration, that is to say, the ejector 5 may be just a part of the slider 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

a housing having a mounting section with a retaining cavity in an interior side of the mounting section;

a cable including a number of wires, an inner layer enclosing the wires, a metallic braiding shielding the inner layer, and an outer jacket covering the metallic braiding;

an inner ring inserted into a slot between the metallic braiding and the inner layer; and an outer ring crimped onto an exterior face of the outer jacket and cooperating with the inner ring to sandwich the metallic braiding shielding and the outer jacket therebetween, the outer ring accommodated in the retaining cavity;

wherein said inner layer axially extends beyond the inner ring and the wires axially extends beyond the inner layer; wherein the inner ring is circular for keeping the wires evenly dispersed in the inner layer without improper compression imposed thereupon while the outer ring is polygonal to provide corresponding planar sides compliantly and intimately abut against a corresponding internal polygonal configuration of the retaining cavity for assuring reliable engagement between the outer ring and the retaining cavity; wherein the outer jacket forms an exterior polygonal configuration to compliantly and intimately received in the outer ring for assuring reliable engagement between the outer ring and the outer jacket.

2. The cable connector assembly as claimed in claim 1, wherein said inner ring is axially longer than the outer ring.

* * * * *